US009572394B2

(12) United States Patent
Heard et al.

(10) Patent No.: US 9,572,394 B2
(45) Date of Patent: Feb. 21, 2017

(54) FOOT-SUPPORT STRUCTURES FOR ARTICLES OF FOOTWEAR

(71) Applicant: NIKE, Inc., Beaverton, OR (US)

(72) Inventors: Joshua P. Heard, Happy Valley, OR (US); Robert M. Bruce, Portland, OR (US); John Hurd, Lake Oswego, OR (US); Alexandre Baudouin, Portland, OR (US); Kevin W. Hoffer, Portland, OR (US); James Molyneux, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 627 days.

(21) Appl. No.: 13/782,831

(22) Filed: Mar. 1, 2013

(65) Prior Publication Data

US 2014/0245640 A1 Sep. 4, 2014

(51) Int. Cl.

| | |
|---|---|
| ***A43B 7/14*** | (2006.01) |
| ***A43B 13/16*** | (2006.01) |
| ***A43B 3/00*** | (2006.01) |
| ***A43B 17/04*** | (2006.01) |
| ***A43B 17/06*** | (2006.01) |
| ***A43B 17/14*** | (2006.01) |

(52) U.S. Cl.

CPC ..... *A43B 7/141* (2013.01); *A43B 3/0052* (2013.01); *A43B 7/142* (2013.01); *A43B 7/143* (2013.01); *A43B 7/144* (2013.01); *A43B 7/145* (2013.01); *A43B 7/1425* (2013.01); *A43B 7/1435* (2013.01); *A43B 7/1445* (2013.01); *A43B 13/16* (2013.01); *A43B 17/04* (2013.01); *A43B 17/06* (2013.01); *A43B 17/14* (2013.01)

(58) Field of Classification Search

CPC ..... A43B 13/16; A43B 7/14; A43B 7/141; A43B 7/1405; A43B 7/142; A43B 7/43; A43B 7/1435; A43B 7/144; A43B 7/1445; A43B 7/145; A43B 3/0052; A43B 17/04; A43B 17/06; A43B 17/14

See application file for complete search history.

(56) References Cited

U.S. PATENT DOCUMENTS

| | | | | | |
|---|---|---|---|---|---|
| 278,337 | A * | 5/1883 | Jones | A43C 15/06 | 36/7.6 |
| 456,060 | A * | 7/1891 | Reilly | A43C 15/063 | 168/31 |
| 832,987 | A | 10/1906 | Linwood | | |
| 1,358,606 | A * | 11/1920 | Arrowsmith | A43B 7/142 | 36/177 |
| 1,435,068 | A * | 11/1922 | Jackson | A43B 23/10 | 36/68 |

(Continued)

*Primary Examiner* — Anna Kinsaul
*Assistant Examiner* — Jocelyn Wu
(74) *Attorney, Agent, or Firm* — Banner & Witcoff, Ltd.

(57) ABSTRACT

Foot-supporting elements for articles of footwear or other products may include: (a) a first diagonally-oriented plate that extends from a lateral heel location of an article of footwear to a medial forefoot location of the article of footwear; and (b) a second diagonally-oriented plate that extends from a medial heel location of the article of footwear to a lateral forefoot location of the article of footwear. These foot-supporting elements may be utilized in foot-receiving devices that may include: (a) a foot-covering member (such as an upper); and (b) a foot-supporting element engaged with the foot-covering member.

23 Claims, 14 Drawing Sheets

(56) References Cited

U.S. PATENT DOCUMENTS 2,002,706 A * 5/1935 Mong ..... A43C 15/06 36/7.6
2,361,972 A * 11/1944 Smith ..... A43C 15/063 36/62
2,435,776 A 2/1948 Geilear
2,608,008 A * 8/1952 Scott ..... A43C 15/063 36/7.7
3,389,481 A * 6/1968 England ..... A43B 3/26 36/97
3,550,597 A * 12/1970 Coplans ..... A43B 13/141 36/144
3,825,017 A * 7/1974 Scrima ..... A43B 7/28 36/181
3,834,045 A 9/1974 Crigger et al.
3,835,558 A * 9/1974 Revill ..... A43B 13/38 36/44
4,302,890 A * 12/1981 Covell ..... A43C 15/06 36/62
4,494,320 A * 1/1985 Davis ..... A43B 13/223 36/103
4,506,460 A * 3/1985 Rudy ..... A43B 7/1495 36/28
4,688,338 A * 8/1987 Brown ..... A43B 17/14 12/146 M
4,766,679 A * 8/1988 Bender ..... A43B 3/0063 36/30 R
4,858,338 A * 8/1989 Schmid ..... A43B 13/187 36/102
5,179,791 A * 1/1993 Lain ..... A43B 17/06 36/144
5,187,883 A * 2/1993 Penney ..... A43B 21/26 36/27
5,191,727 A * 3/1993 Barry ..... A43B 5/06 36/107
5,203,095 A * 4/1993 Allen ..... A43B 21/32 36/27
5,285,583 A * 2/1994 Aleven ..... A43B 13/38 36/43
5,329,704 A * 7/1994 Martin, Jr. ..... A43C 15/00 36/7.1 R
5,448,839 A * 9/1995 Blissett ..... A43B 7/14 36/103
5,546,680 A * 8/1996 Barma ..... A43B 13/14 36/108
D380,289 S 7/1997 Sand
5,845,420 A 12/1998 Buccianti et al.
5,960,566 A 10/1999 Brown
6,092,307 A * 7/2000 Singer ..... A43B 9/00 36/12
6,199,303 B1 * 3/2001 Luthi ..... A43B 7/142 36/107
6,226,897 B1 5/2001 Sand
D446,917 S 8/2001 Brown
6,438,868 B1 * 8/2002 Fini ..... A43B 9/00 12/142 T
6,497,058 B2 * 12/2002 Dietrich ..... A43B 13/14 36/142
6,502,330 B1 * 1/2003 David ..... A43B 13/026 36/144
D471,698 S 3/2003 Brown
6,594,922 B1 * 7/2003 Mansfield ..... A43B 7/141 36/145
6,718,656 B2 4/2004 Houser et al.
6,775,930 B2 * 8/2004 Fuerst ..... A43B 13/026 12/146 B
6,817,112 B2 11/2004 Berger et al.
6,860,034 B2 * 3/2005 Schmid ..... A43B 13/181 36/27
D507,863 S 8/2005 McClaskie
7,041,075 B2 * 5/2006 Sullivan ..... A61F 5/14 602/23
7,082,702 B2 * 8/2006 Cretinon ..... A43B 13/026 36/107
7,096,605 B1 * 8/2006 Kozo ..... A43B 7/08 36/103
7,263,788 B2 * 9/2007 Johnson ..... A43B 3/0063 36/107
7,299,567 B2 * 11/2007 Berend ..... A43B 7/142 36/107
7,331,124 B2 2/2008 Meschan
7,370,443 B2 * 5/2008 Gibert ..... A43B 3/0052 36/103
7,434,337 B2 * 10/2008 Gibert ..... A43B 3/0052 36/25 R
7,627,963 B2 * 12/2009 Kilgore ..... A43B 13/141 36/102
7,634,861 B2 * 12/2009 Kilgore ..... A43B 13/141 36/102
7,832,119 B2 * 11/2010 Gilmore ..... A61F 5/14 36/143
7,886,460 B2 * 2/2011 Teteriatnikov ..... A43B 13/145 36/25 R
7,980,006 B2 * 7/2011 Aveni ..... A43B 7/1495 36/114
8,074,377 B2 12/2011 Nishiwaki et al.
8,209,883 B2 * 7/2012 Lyden ..... A43B 1/0081 2/239
8,220,186 B2 * 7/2012 Nomi ..... A43B 13/16 36/105
8,365,440 B2 * 2/2013 Rivas ..... A43B 3/0036 36/107
8,387,279 B2 * 3/2013 Pauk ..... A43B 13/12 36/25 R
8,479,413 B2 * 7/2013 Avent ..... A43B 7/14 36/108
8,984,775 B2 * 3/2015 Dombrow ..... A43B 23/0295 36/102
9,107,473 B2 * 8/2015 Heard ..... A43B 13/14
9,131,746 B2 * 9/2015 Arciuolo ..... A43B 7/00
2004/0221489 A1 * 11/2004 Hung ..... A43B 7/32 36/136
2006/0137228 A1 * 6/2006 Kubo ..... A43B 3/0036 36/103
2007/0101617 A1 * 5/2007 Brewer ..... A43B 7/08 36/103
2009/0019730 A1 1/2009 Salminen et al.
2011/0247235 A1 * 10/2011 de Roode ..... A43B 7/142 36/44
2013/0180130 A1 * 7/2013 Giovale ..... A43C 15/02 36/62

* cited by examiner

FOOT-SUPPORT STRUCTURES FOR ARTICLES OF FOOTWEAR

BACKGROUND

FIG. 1 shows a conventional athletic shoe 100. Shoe 100 includes an upper 102 and a sole structure 104. The upper 102, which may include a Strobel or other lasting element (not shown), defines a foot-receiving chamber that may be accessed through opening 106. The upper 102 provides a covering for a wearer's foot and securely receives and positions the foot with respect to the sole structure 104. The sole structure 104 may be secured to a lower portion of the upper 102 and positioned between the foot and the ground when the shoe 100 is in use. In addition to attenuating ground reaction forces, the sole structure 104 may provide traction and help control foot motion, such as pronation.

The sole structure 104 may have a layered configuration that includes a resilient midsole 108 (e.g., formed, at least in part, from a polymer foam material) and a ground-contacting outsole 110 that provides both abrasion-resistance and traction. A separate insole may also be included (e.g., within the upper 102). Suitable polymer foam materials for at least portions of the midsole 108 include ethylvinylacetate ("EVA") or polyurethane ("PU") that compress resiliently under an applied load to attenuate ground reaction forces.

For example, some footwear users participate in events or exercise programs that require frequent direction changes, often at high speeds. Such direction changes typically require the athlete to solidly plant and then push off one foot in a sideways direction, at times with some amount of twisting or spinning action. During these and other types of events, a user's foot can experience significant forces and motions. Designing footwear to support and/or protect the foot during such activities remains an ongoing challenge.

SUMMARY

The following presents a general summary of some embodiments. This summary is not intended to identify key or critical elements of the invention or to delineate the scope of the invention. The following summary merely presents some concepts in a general form as a prelude to a more detailed description provided below.

At least some embodiments include support elements. Such support elements may be incorporated into an article of footwear and include: a first diagonally-oriented plate that extends from a lateral heel location in the article of footwear to a medial forefoot location in the article of footwear. Such support elements may further include a second diagonally-oriented plate that extends from a medial heel location in the article of footwear to a lateral forefoot location in the article of footwear. The first plate and the second plate may cross in an arch area.

Each of the first and second plates may include a longitudinal portion configured to extend under a wearer's foot and a heel support flange extending upward from an edge of the longitudinal portion of the heel region. The article of footwear may further include a ground contacting member engaged with at least one of the first plate or the second plate.

Still additional embodiments may include foot-receiving devices, such as shoes or articles of footwear. Such devices may include, for example: (a) a foot-covering member (such as an upper or a portion thereof); and (b) a support element engaged with the foot-covering member. The support element may be incorporated into the article of footwear and include: a first diagonally-oriented plate that extends from a lateral heel location in the article of footwear to a medial forefoot location in the article of footwear. Such a support element may further include a second diagonally-oriented plate that extends from a medial heel location in the article of footwear to a lateral forefoot location in the article of footwear. The first plate and the second plate cross in an arch area. Each of the first and second plates may include a longitudinal portion configured to extend under a wearer's foot and a heel support flange extending upward from an edge of the longitudinal portion of the heel region. The foot-receiving device may further comprise a ground-contacting member engaged with the support element. Additionally, the foot-covering member may form at least a portion of an upper for an article of footwear, the support element may form at least a portion of a midsole for the article of footwear, and the ground-contacting member may form at least a portion of an outsole for the article of footwear.

BRIEF DESCRIPTION OF THE DRAWINGS

A more complete understanding of various embodiments may be acquired by referring to the following description in consideration with the accompanying drawings, in which like reference numbers indicate like features, and wherein.

DETAILED DESCRIPTION

Figure 1:
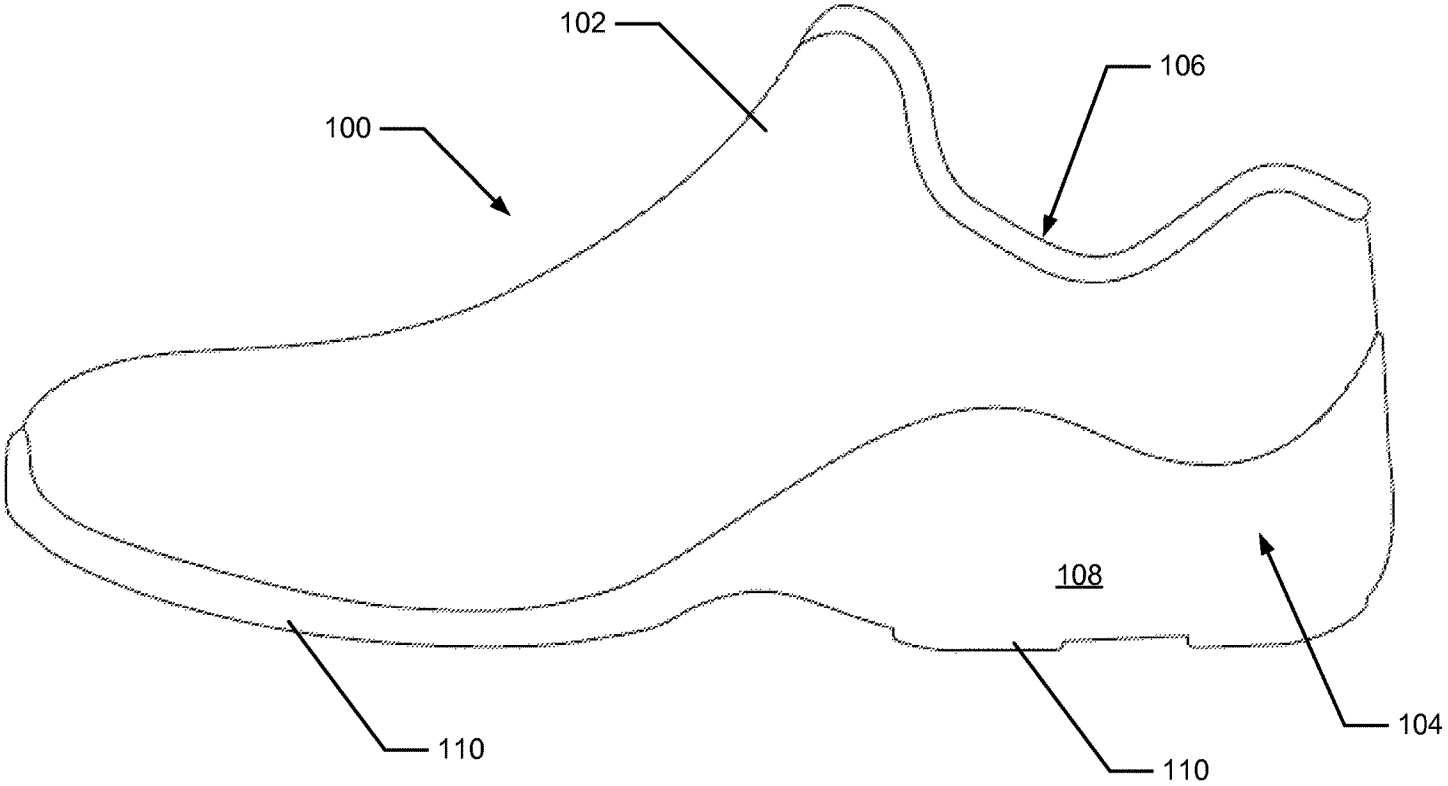
Fig. 1 (Prior Art)
FIG. 1 illustrates an example of a conventional athletic shoe.

At least some embodiments may include support elements that can be incorporated into an article of footwear. Such support elements may help decouple medial and lateral sides of a footwear sole structure and reduce or prevent lateral and shear movement of one portion of the article of footwear with respect to other portions of the product. Footwear equipped with such support elements may provide more solid feel, particularly when a wearer performs a "cutting" maneuver or other rapid change of direction.

In the following description of several example embodiments, reference is made to the accompanying drawings, which form a part hereof. It is to be understood that other specific arrangements of parts, example systems, and environments may be utilized and structural and functional modifications may be made without departing from the scope of the present invention. Also, while the terms "top," "bottom," "side," "front," "back," "above," "below," "under," "over," and the like may be used in this specification to describe various example features and elements of example embodiments, these terms are used herein as a matter of convenience, e.g., based on the example orientations shown in the figures and/or a typical orientation during use. Unless indicated otherwise, nothing in this specification should be construed as requiring a specific three dimensional orientation of structures with respect to an external object or the external environment in order to fall within the scope of this invention.

DEFINITIONS

To assist and clarify subsequent description of various embodiments, various terms are defined herein. Unless context indicates otherwise, the following definitions apply throughout this specification (including the claims). "Shoe" and "article of footwear" are used interchangeably to refer to articles intended for wear on a human foot. A shoe may or may not enclose the entire foot of a wearer. For example, a shoe could include a sandal or other article that exposes large portions of a wearing foot. The "interior" of a shoe refers to space that is occupied by a wearer's foot when the shoe is worn. An "interior side" (or surface) of a shoe element refers to a face of that element that is (or will be) oriented toward the shoe interior in a completed shoe. An "exterior side" (or surface) of an element refers to a face of that element that is (or will be) oriented away from the shoe interior in the completed shoe. In some cases, the interior side of an element may have other elements between that interior side and the interior in the completed shoe. Similarly, an exterior side of an element may have other elements between that exterior side and the space external to the completed shoe.

A longitudinal foot axis refers to a horizontal heel-toe axis along the center of the foot, while that foot is resting on a horizontal surface that is generally parallel to a line along the second metatarsal and second phalangeal bones. A transverse foot axis refers to a horizontal axis across the foot that is generally perpendicular to the longitudinal axis. A longitudinal direction is parallel to the longitudinal axis or has a primary directional component that is parallel to the longitudinal axis. A transverse direction is parallel to a transverse axis or has a primary directional component that is parallel to a transverse axis.

Shoe elements can be described based on regions and/or anatomical structures of a human foot wearing that shoe, and by assuming that shoe is properly sized for the wearing foot. As an example, a forefoot region of a foot includes the metatarsal and phalangeal bones. A forefoot element of a shoe is an element having one or more portions located over, under, to the lateral and/or medial side of, and/or in front of a wearer's forefoot (or portion thereof) when the shoe is worn. As another example, a midfoot region of a foot includes the cuboid, navicular, medial cuneiform, intermediate cuneiform and lateral cuneiform bones and the heads of the metatarsal bones. A midfoot element of a shoe is an element having one or more portions located over, under and/or to the lateral and/or medial side of a wearer's midfoot (or portion thereof) when the shoe is worn. As a further example, a heel region of a foot includes the talus and calcaneus bones. A heel element of a shoe is an element having one or more portions located over, under, to the lateral and/or medial side of, and/or behind a wearer's heel (or portion thereof) when the shoe is worn. The forefoot region may overlap with the midfoot region, as may the midfoot and heel regions.

Specific Examples of the Invention

The various figures in this application illustrate examples of support elements and their arrangement in an article of footwear according to certain embodiments.

Figure 2:
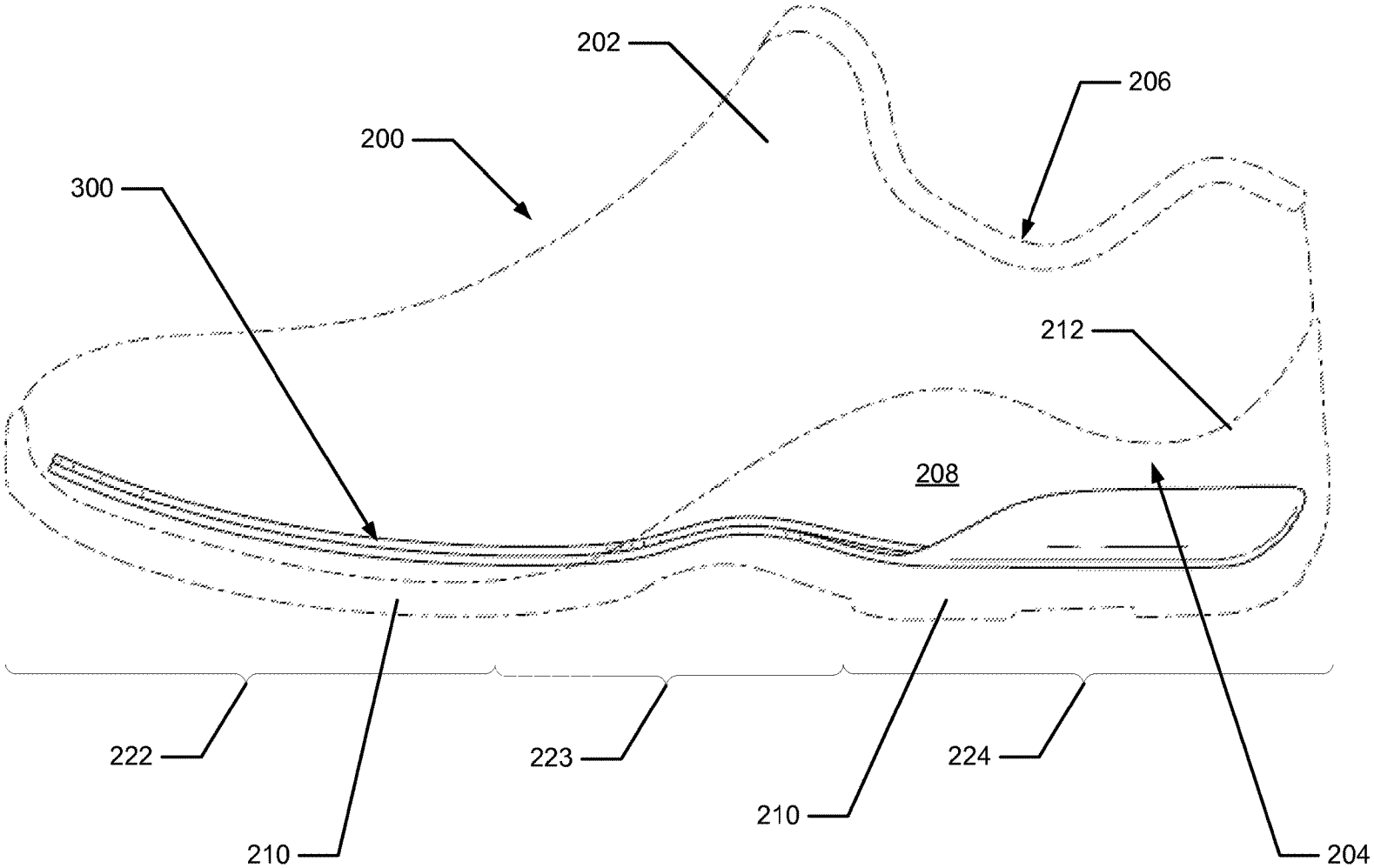
FIG. 2 illustrates an article of footwear that includes a support element according to at least some embodiments.
Figure 3B:
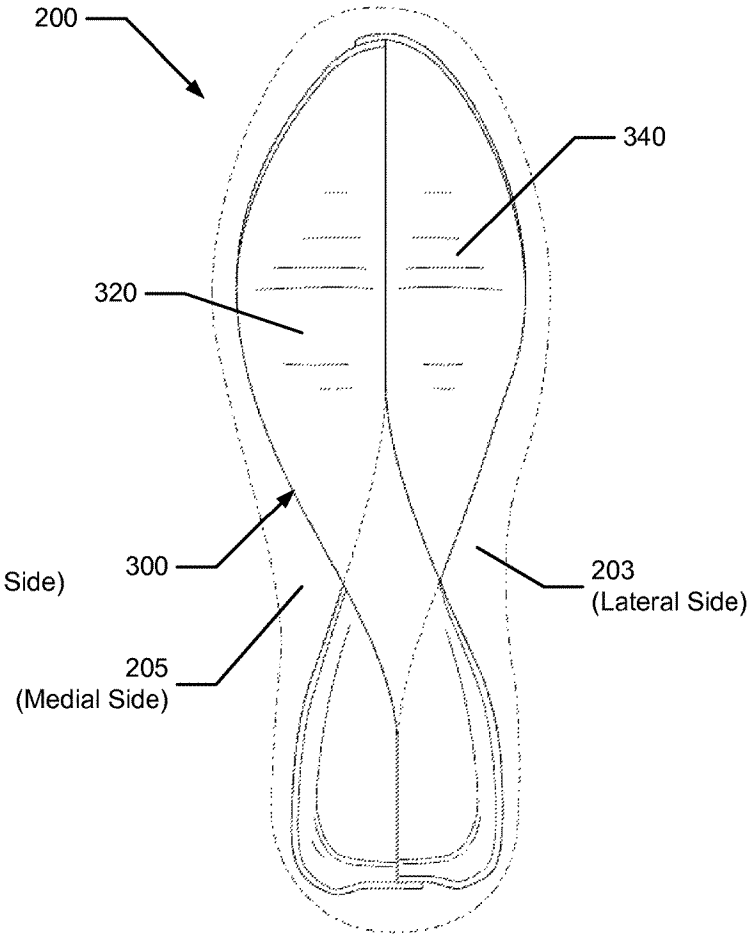
FIG. 3B illustrates a top view of the support element incorporated into the footwear of FIG. 2.
Figure 3A:
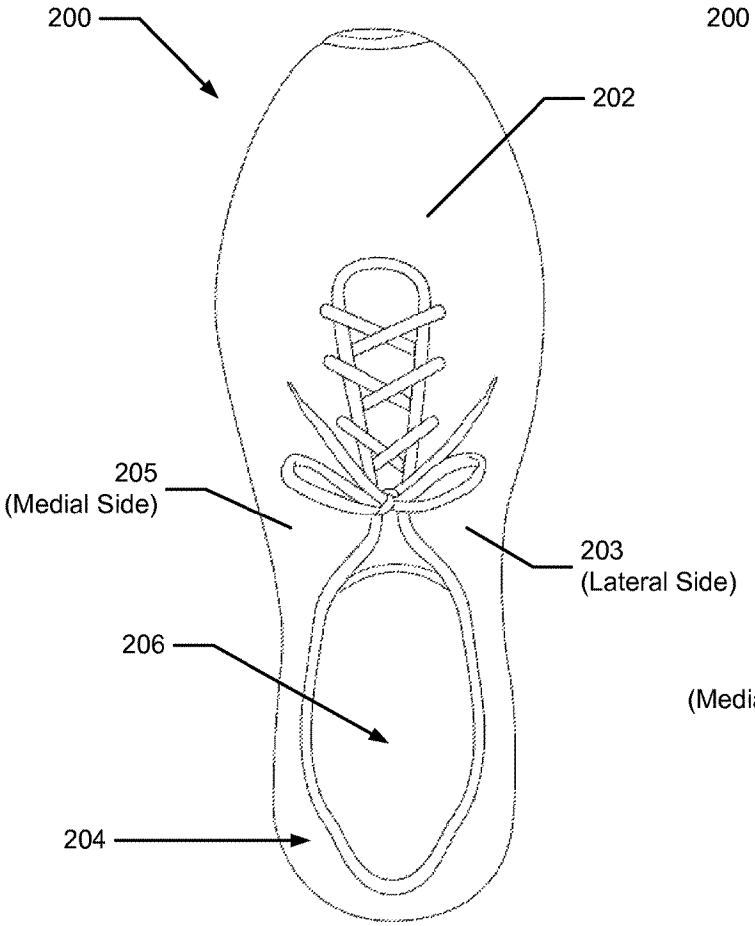
FIG. 3A illustrates a top view of the footwear of FIG. 2.

FIGS. 2 through 3B illustrate a shoe 200 that includes a support element 300 in accordance with at least some embodiments. FIG. 2 is a lateral side view of the support element 300. FIG. 3A is a top view of the shoe 200. FIG. 3B is a top view of the support element 300 incorporated into the shoe 200 according to at least some embodiments. So as to indicate the location of support element 300 within the shoe 200, some parts of shoe 200 are shown in FIG. 2 with uneven broken lines. The shoe 200 includes an upper 202 and a sole structure 204. The upper 202 and the sole structure 204 may be connected to one another in any suitable or desired manner, including in conventional manners known and used in the art, such as via adhesives or cements, via stitching or sewing, mechanical connectors, fusing techniques, or the like. The upper 202 forms a foot-receiving chamber into which a wearer's foot may be inserted, e.g., via opening 206. The sole structure 204 may include a resilient midsole 208 (e.g., formed, at least in part, from a polymer foam material, as described above) and a ground-contacting outsole 210 that may provide both abrasion-resistance and traction. Shoe 200 may also include a comfort-enhancing insole (not shown in FIG. 2) within upper 202. The shoe 200 (or other foot-receiving device structure) further may include one or more closure elements or systems of any suitable or desired type without departing from certain embodiments, including conventional closure elements and/or systems known and used in the art. Examples of such systems include: laces, zippers, buckles, hook-and-loop fasteners, etc. In at least some example embodiments, the shoe 200 may constitute an article of athletic footwear.

For convenience, a forefoot region 222, a midfoot region 223, and a heel region 224 are approximately indicated in FIG. 2. Additionally, the various material elements forming the upper 202 and the sole structure 204, combine to form a structure having a lateral side 203 and an opposite medial side 205, as defined in FIGS. 3A and 3B. The lateral side 203 extends through each of regions 222-224 and is generally configured to contact and cover a lateral surface of the foot. The medial side 205 extends through each of regions 222-224 and is generally configured to contact and cover an opposite medial surface of the foot.

Additionally, as illustrated in FIG. 2, the example shoe 200 may include a support element 300. The support element 300, as will be explained further below, may comprise support plates for supporting a wearer's foot in an article of footwear 200. The support element 300 may support, for example, a foam-filled or fluid filled bladder-type midsole 208, a sock liner, etc. In some embodiments, and as discussed below the support element 300 may be located below the upper 202 and above the midsole 208 of the shoe 200. In other embodiments, support element 300 may be located between midsole 208 and an outsole. In yet other embodiments, support element 300 may be may be embedded in midsole 208. In still other embodiments, support element 300 may be located within upper 202.

Figure 3C:
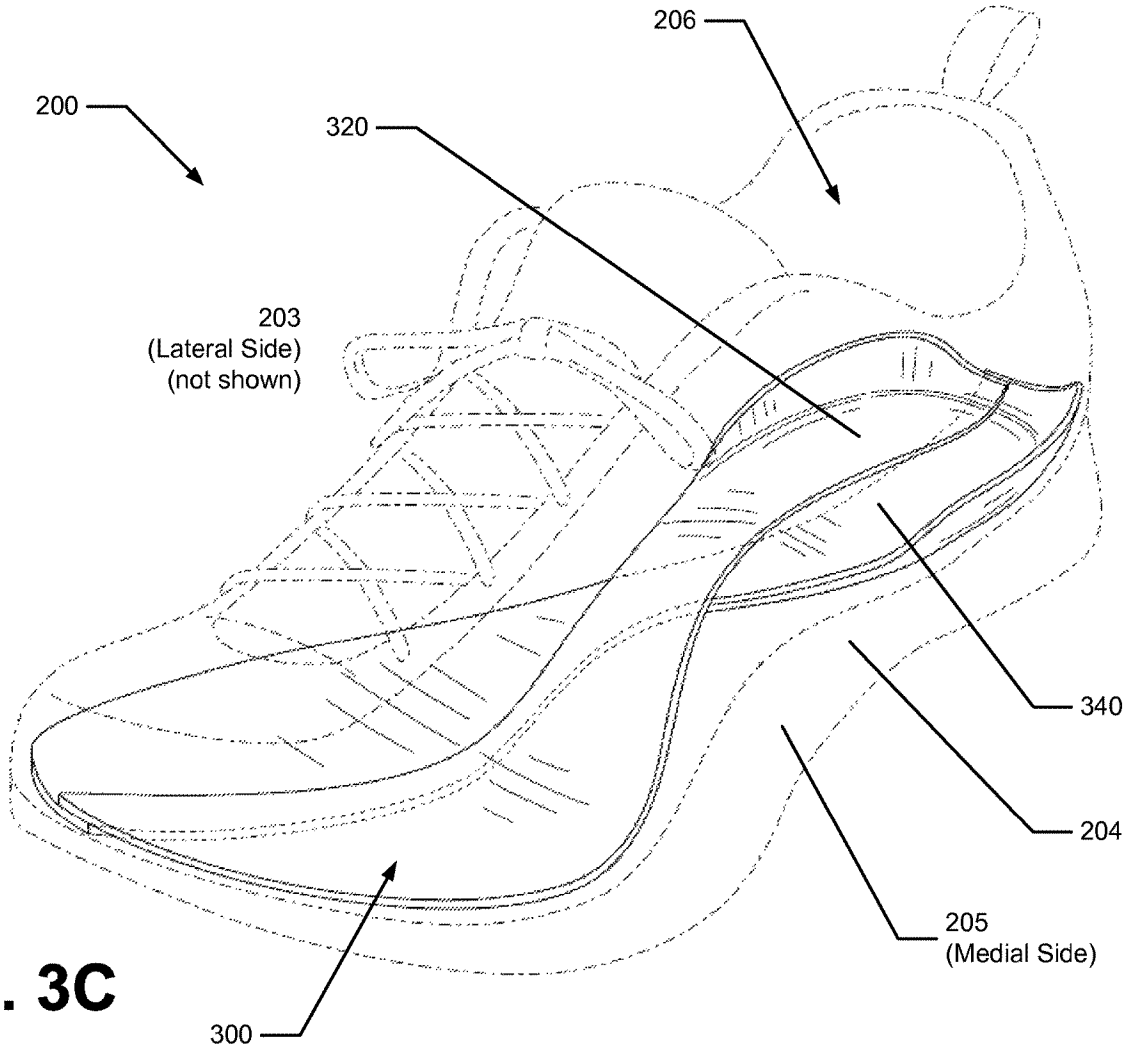
FIG. 3C illustrates a front-lateral perspective view of the support element of FIG. 2, with other parts of footwear shown in uneven broken lines.
Figure 4A:
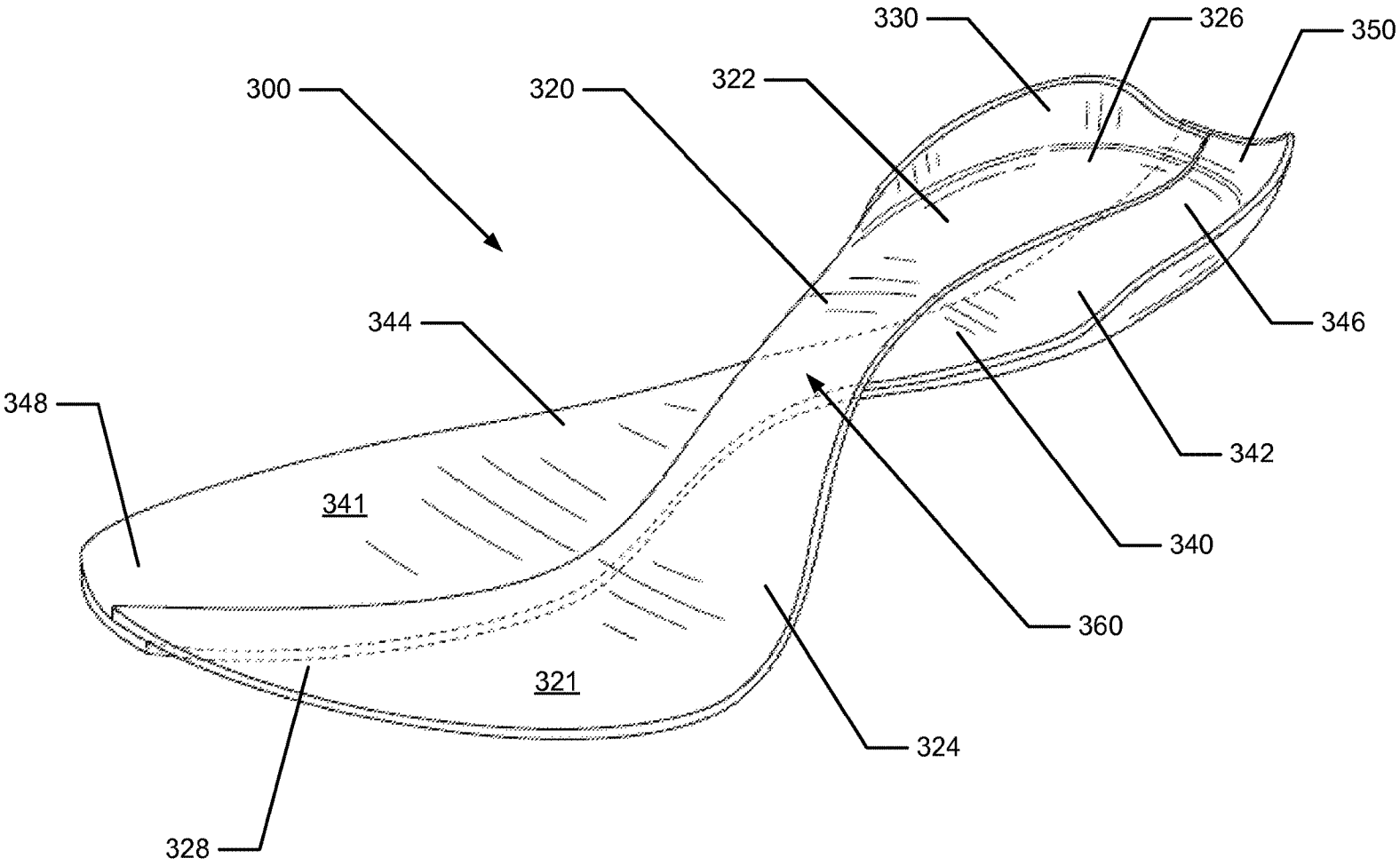
FIG. 4A illustrates a front-lateral perspective view of the support element of FIG. 2.
Figure 4B:
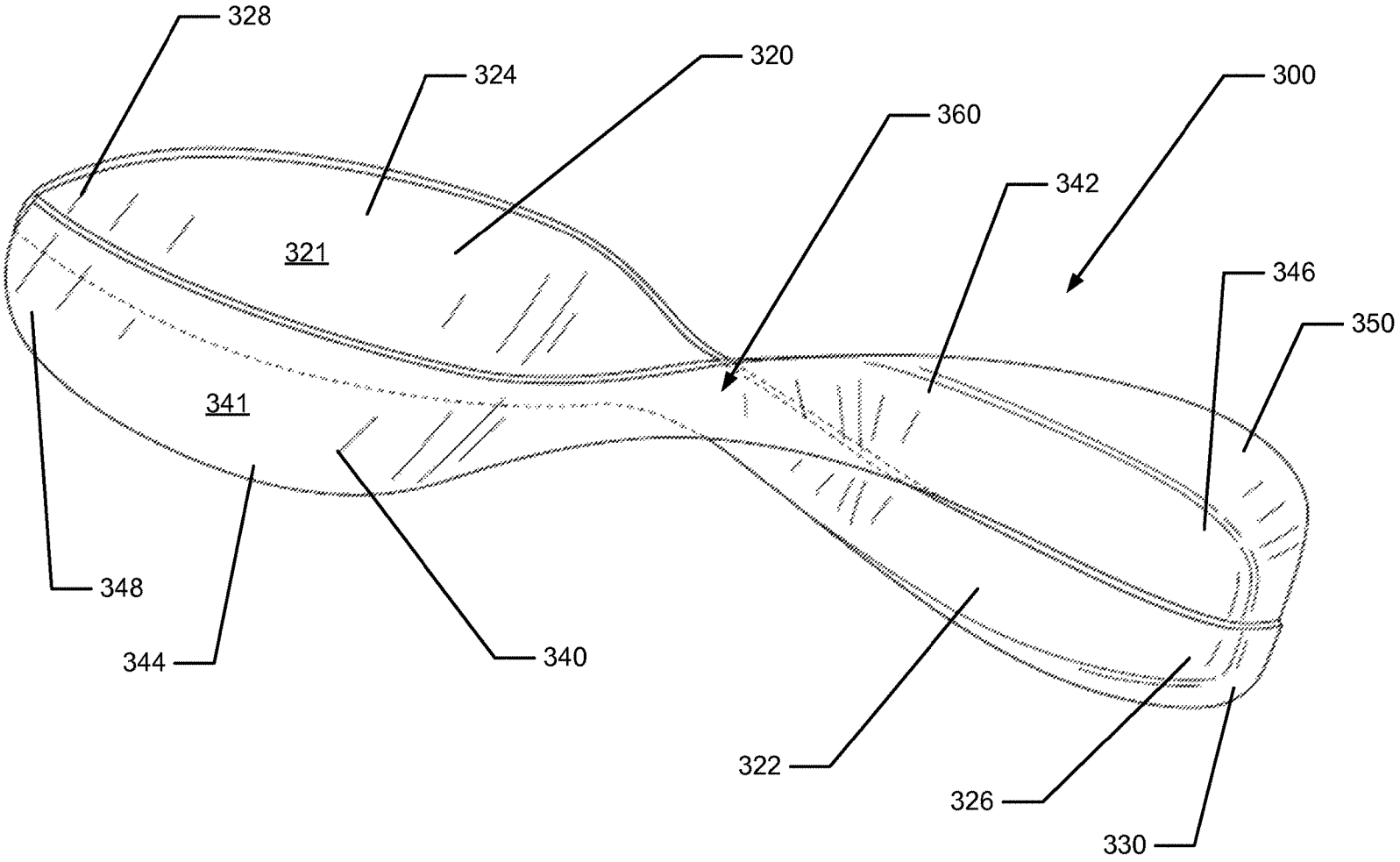
FIG. 4B illustrates a bottom-lateral perspective view of the support element of FIG. 2.
Figure 5A:
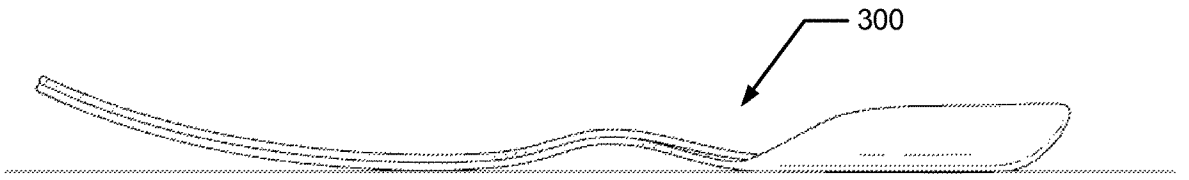
FIGS. 5A-5C illustrate side views of the support element of FIG. 2.
Figure 5B:
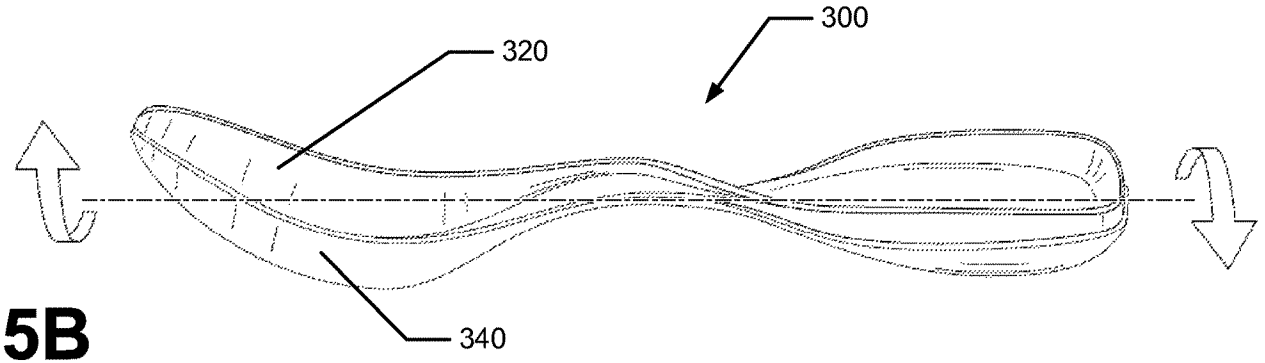
Figure 5C:
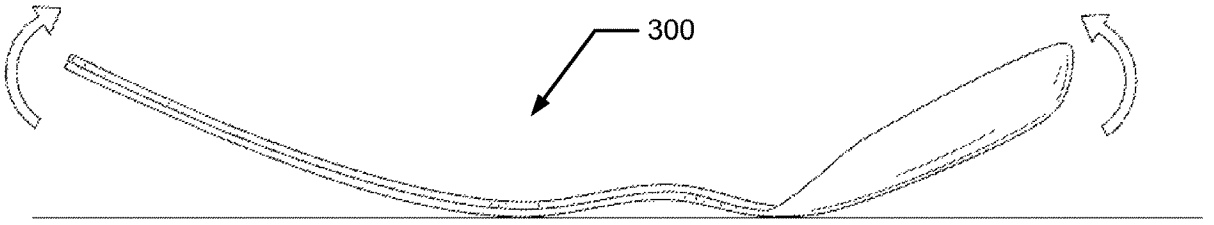
Figure 6A:
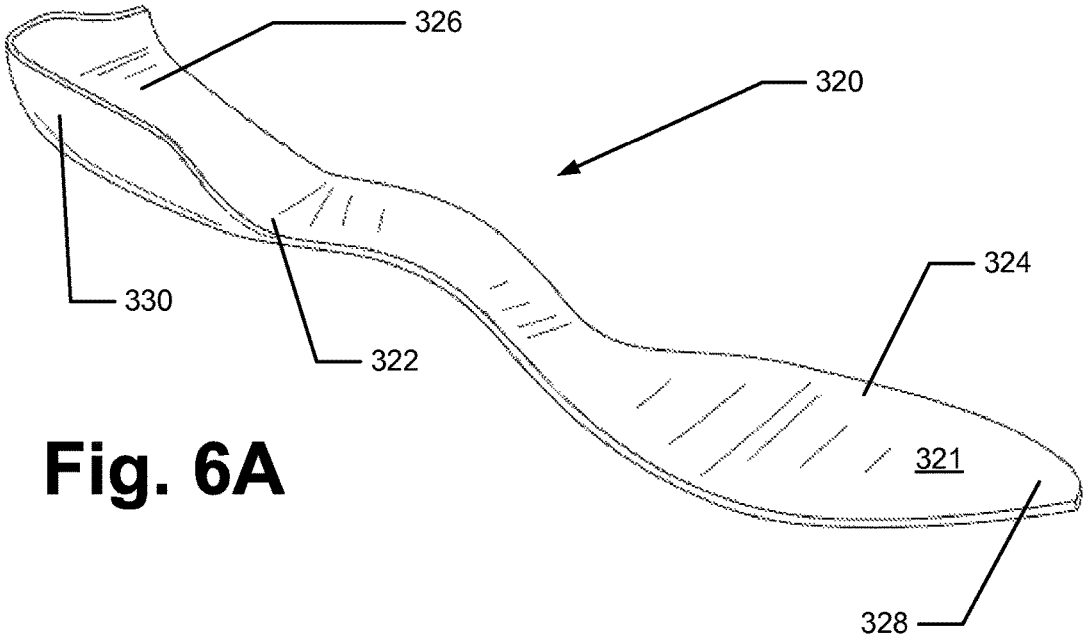
FIG. 6A illustrates a lateral-front perspective view of the support element of FIG. 2.
Figure 6B:
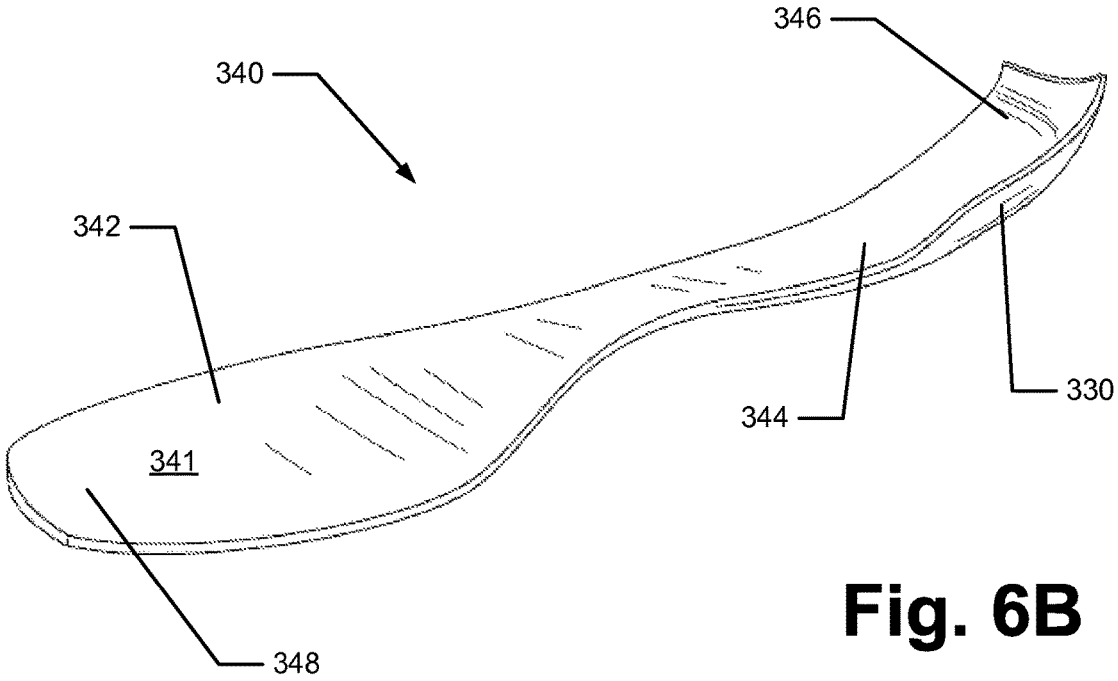
FIG. 6B illustrates a medial-front perspective view of a portion of the support element of FIG. 2.

FIGS. 3C through 6B illustrate example support element 300. Specifically, FIG. 3C illustrates a front-lateral perspective view of the support element 300, with other parts of footwear shown in uneven broken lines. FIG. 4A illustrates a front-lateral perspective view of the support element 300. FIG. 4B illustrates a bottom-lateral perspective view of the support element 300. FIGS. 5A-5C illustrate side views of the support element 300. FIG. 6A illustrates a lateral-front perspective view of the support element 300. FIG. 6B illustrates a medial-front perspective view of the support element 300.

The example support element 300 may include a first plate 320 and a second plate 340. Generally, the first plate 320 and the second plate 340 may be separate portions of the support element 300. This example support element 300 may be provided at any desired location within a shoe construction, e.g., immediately beneath an insole or sock liner; included within or on top of a midsole component; between a midsole component and an outsole component; etc. Additionally, this example support element 300 may be incorporated into the shoe 200 with various methods known and used in the art, such as glued or fixed inside the upper, attached to the bottom of the upper, embedded into the midsole or another part of the sole structure, or resting inside the upper and stitched to the upper.

The support element 300 may be made from any suitable or desired type of material, including materials conventionally used in base plates for sole structures and/or other portions of footwear products. As more specific examples, the support element 300 may be made from one or metals (e.g., aluminum, stainless steel, titanium), one or more thermoset plastics, one or more thermopolymers (e.g., thermoplastic polyurethane, polyamides such as NYLON, etc.) and/or other materials, e.g., materials that have limited tensile stretch under typical footwear use conditions. In some embodiments, the support element 300 could be a composite material formed from a polymer resin (e.g., polyester or epoxy) having reinforcing fibers (e.g., carbon and/or glass) embedded therein. Another example material from which the support element 300 can be formed includes a polyether-block co-polyamide polymer such as that sold under the trade name PEBAX® by Atofina Corporation of Puteaux, France. In some examples, the support element 300 (including the first plate 320 and the second plate 340) will be integrally formed as a unitary, one-piece construction, e.g., by molding, such as by injection, compression, or blow molding processes. Of course, other ways of producing the support element 300, and indeed a wide variety of support element constructions and structures, may be used without departing from this invention.

The support element 300 may be fixed to the midsole structure 208 or other locations of the footwear structure in any desired manner without departing from this invention. For example, adhesives or cements may be used to adhere the support element 300 to the underside of the midsole 208. Also, the support element 300 may include one or more raised engagement elements (not shown) that fit into corresponding grooves or openings provided in the midsole 208. The engagement elements, when fit into corresponding grooves or openings provided in the midsole 208, can help position and prevent undesired movement of support element 300 with respect to the midsole 208. Any desired number, shape, arrangement, or construction of engagement elements in the support element and corresponding openings or grooves in the impact-attenuating element structure (or vice versa) may be provided without departing from this invention. Also, if desired, each of the support element 300 and the midsole 208 may contain combinations of raised engagement elements, openings, and/or grooves without departing from the invention. As still another example, if desired, the support element 300 may be embedded into the midsole 208 (e.g., during the process of molding a midsole 208).

The first plate 320 and the second plate 340 may extend from the heel region 224 to the forefoot region 222 of the shoe 200. Generally, the first plate 320 may be oriented diagonally and extend diagonally from a lateral heel location in the shoe 200 to a medial forefoot location in the shoe 200. The second plate 340 may be oriented diagonally and extend diagonally from a medial heel location of the shoe 200 to a lateral forefoot location of the shoe 200.

The first plate 320 may be located on top of the second plate 340. Generally, the first plate 320 is located or crossed over the second plate 340 because a user's weight typically moves along the user's foot from the lateral heel area of the foot (at foot strike) to the medial forefoot area (at the user's big toe, for toe off). This diagonal crossing of the first plate 320 and the second plate 340 and the construction of the support element 300 helps to decouple the medial and lateral sides of the support element 300. This decoupling of the medial and lateral sides of the support element 300 allows the support element 300 to more easily follow the movement of a user's foot within the shoe 200. In the example embodiment, the first plate 320 and the second plate 340 can move separately and independently of each other with the movement of the user's foot within the shoe 200.

The first plate 320, as illustrated in FIGS. 4A, 4B, and 6A, may include a longitudinal portion 321 that extends the longitudinal length of the shoe 200. The longitudinal portion 321 may include a medial side 322 which coincides with the medial side 205 of the shoe 200. The longitudinal portion 321 also includes a lateral side 324 opposite the medial side 322, which coincides with the lateral side 203 of the shoe 200. The longitudinal portion 321 may also include a heel end 326 that coincides with the heel region 224 of the shoe 200. The longitudinal portion 321 also includes a forefoot end 328 opposite the heel end 326 that coincides with the forefoot region 222 of the shoe 200. The first plate 320 may be oriented diagonally in the shoe 200 such that the first plate 320 extends from a lateral heel location of the shoe 200 to a medial forefoot location of the shoe 200. The first plate 320 may extend longitudinally from the heel region 224 to the forefoot region 222. Additionally, the forefoot end 328 of the first plate 320 may be approximately half the width of the forefoot region 222 of the shoe 200. Similarly, the heel end 326 of the first plate 320 may be approximately half the width of the heel region 224 of the shoe 200.

The second plate 340, as illustrated in FIGS. 4A, 4B, and 6B, may include a longitudinal portion 341 that extends the longitudinal length of the shoe 200. The longitudinal portion 341 may include a medial side 342 which coincides with the medial side 205 of the shoe 200. The longitudinal portion 341 may also include a lateral side 344 opposite the medial side 342, which coincides with the lateral side 203 of the shoe 200. The longitudinal portion 341 may also include a heel end 346 that coincides with the heel region 224 of the shoe 200. The longitudinal portion 341 also includes a forefoot end 348 opposite the heel end 346, which coincides with the forefoot region 222 of the shoe 200. The second plate 340 may be oriented diagonally in the shoe 200 such that the second plate 340 extends from a medial heel location of the shoe 200 to a lateral forefoot location of the shoe 200. The second plate 340 may extend longitudinally from the heel region 224 to the forefoot region 222. Additionally, the forefoot end 348 of the second plate 340 may be approximately half the width of the forefoot region 222 of the shoe 200. Similarly, the heel end 346 of the second plate 340 may be approximately half the width of the heel region 224 of the shoe 200.

In accordance with various embodiments, the first plate 320 and the second plate 340 may cross and narrow in an arch area of the foot, thereby defining a plate overlap area 360. The plate overlap area 360 may be located and configured to provide comfortable support in the arch area of the foot and the shoe 200. As was described above, in one embodiment, the first plate 320 crosses over the top of the second plate 340. In another embodiment, the second plate 340 may cross over the top of the first plate 320.

The first plate 320 may include a first heel support flange 330 and the second plate 340 may include a second heel support flange 350. The first heel support flange 330 and the second heel support flange 350 may provide a surface for supporting a footwear insole, the wearer's heel, and/or a portion of an upper 202 at the heel area of a shoe 200. The first heel support flange 330 may extend upward from an edge of the longitudinal portion 321 in the heel region of the first plate 320. The second heel support flange 350 may extend upward from an edge of the longitudinal portion 341 in the heel region of the second plate 340. The heel support flanges 330 and 350 may extend upward from their respective longitudinal portions towards the opening 206 of the shoe 200 and along a heel cup or heel counter of the shoe 200. The heel support flanges 330 and 350 may provide additional support to the heel of a user's foot when located in the shoe 200. If desired, the heel support flanges 330 and 350 may constitute a portion of an upper of a shoe, a heel cup, a heel counter, or the like, in accordance with the example embodiments.

The first heel support flange 330 may be integrally formed with the longitudinal portion 321 of the first plate 320 (e.g., molding the first plate 320 with the heel flange 330 as a single piece). The second heel support flange 350 may be integrally formed with the longitudinal portion 342 of the second plate 340 (e.g., molding the second plate 340 with the heel flange 350 as a single piece). In other examples, the first heel support flange 330 may be formed separately and then attached to the longitudinal portion 321 of the first plate 320 and the second heel support flange 350 may be formed separately and then attached the longitudinal portion 341 of the second plate 340. For example, adhesives or cements may be used to fix the heel support flange and the longitudinal portions together. Fusing techniques also may be used to fix the heel support flange and the longitudinal portions together. In at least some examples of these embodiments, the heel support flange 330, 350 will be made from one or metals (e.g., aluminum, stainless steel, titanium), one or more thermoset plastics, one or more thermopolymers (e.g., thermoplastic polyurethane, polyamides such as NYLON, etc.) and/or other materials, e.g., materials that have limited tensile stretch under typical footwear use conditions. In some embodiments, the support element 300 could be a composite material formed from a polymer resin (e.g., polyester or epoxy) having reinforcing fibers (e.g., carbon and/or glass) embedded therein. Another example material from which the support element 300 can be formed includes a polyether-block co-polyamide polymer such as that sold under the trade name PEBAX® by Atofina Corporation of Puteaux, France. When the heel support flange 330, 350 is a separate part from the first plate 320 and the second plate 340, the heel support flange 330, 350 may be capable of engaging with and bonding to the material of the longitudinal portion 321 of the first plate 320 and/or the longitudinal portion 341 of the second plate 340 using a suitable cement or adhesive.

Returning now to FIGS. 3A-3C, as described above, an example shoe 200 (or other foot-receiving device structure) in accordance with this invention is illustrated. Specifically, this example shoe 200 includes the upper 202 (or other foot-covering member) and the sole structure 204 engaged together. The shoe 200 further includes a support element 300 in the form of the first plate 320 and the second plate 340. The construction of the first plate 320 and the second plate 340 being diagonally crossed with the first plate 320 extending from the lateral heel location on the shoe 200 to the medial forefoot location on the shoe 200 and the second plate 340 extending from the medial heel location on the shoe 200 to the lateral forefoot location on the shoe 200 helps to decouple the medial and lateral sides of the support element and allows the user's foot to be supported more closely to the movement of the foot inside the shoe 200. In an example embodiment, the first plate 320 and the second plate 340 are not fixed relative to one another. In another example embodiment, the first plate 320 and the second plate 340 may be fixed relative to each other and bonded at the plate overlap area 360. For example, adhesives or cements may be used to bond the first plate 320 and the second plate 340 together at the plate overlap area 360.

As illustrated in FIGS. 5A-5C, the support element 300 may be flexible such that the support element 300 twists about both a vertical and horizontal axis as a user's foot may bend in the shoe 200 during a user's movement. FIGS. 5A-5C illustrate how the support element 300 allows the user's foot to be supported more closely to the movement of the foot inside the shoe 200. When a person wearing a shoe 200 equipped with the support element 300 plants his/her foot and pushes off in a sideways manner (e.g., in order to make a cut or quickly change directions), the support element 300 will help to provide better foot support for the direction change action and resists and/or assists various foot motions/forces during different activities.

Figure 7A:
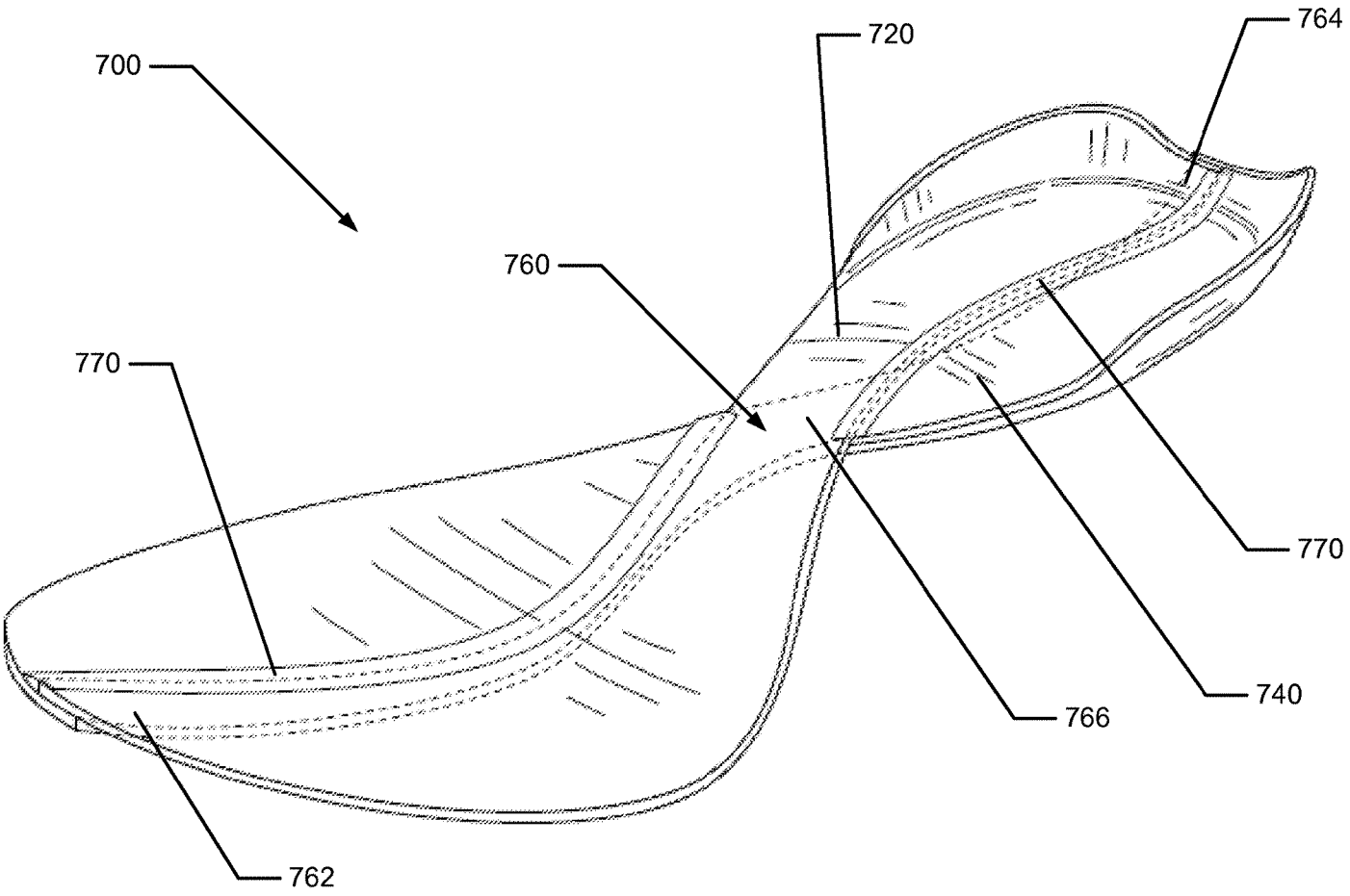
FIG. 7A illustrates a front-lateral perspective view of another example support element according to at least some embodiments.
Figure 7B:
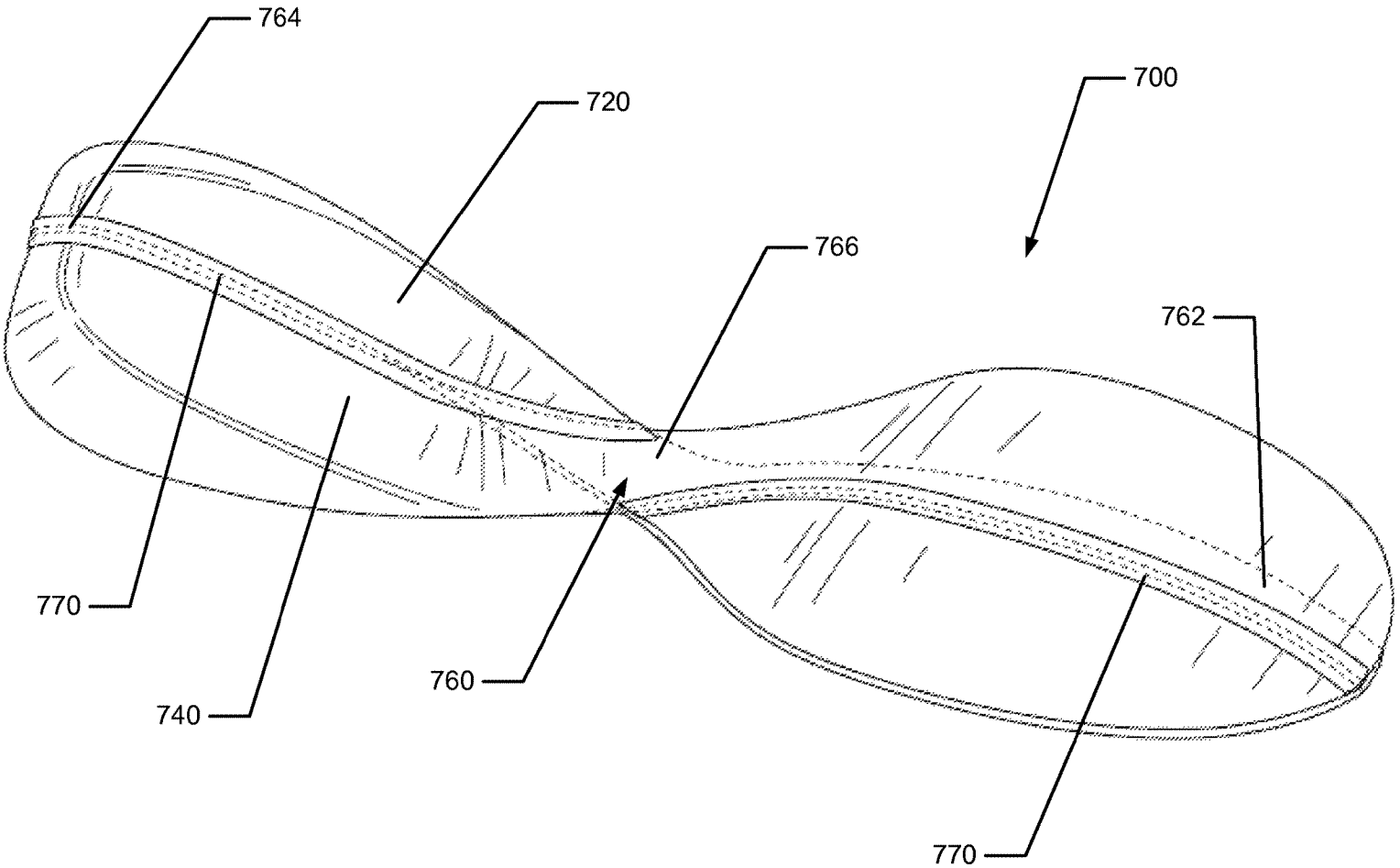
FIG. 7B illustrates a bottom-lateral perspective view of the support element of FIG. 7A.

FIGS. 7A and 7B illustrate a support element 700 in accordance with additional embodiments. FIG. 7A illustrates a front-lateral perspective view of the support element 700. FIG. 7B illustrates a bottom-lateral perspective view of the support element 700. The example support element 700 may include a first plate 720 and a second plate 740. The first plate 720 and the second plate 740 may extend longitudinally from a heel portion to a forefoot portion of a shoe. Generally, the first plate 720 may be oriented diagonally and extend diagonally from a lateral heel location in the shoe to a medial forefoot location in the shoe. The second plate 740 may be oriented diagonally and extend diagonally from a medial heel location of the shoe to a lateral forefoot location of the shoe.

The first plate 720 and the second plate 740 may cross and narrow in an arch area of the foot, thereby defining an overlap area 760. The overlap area 760 may include one or more overlap portions, such as forefoot overlap portion 762, a heel overlap portion 764, and an arch overlap portion 766. The arch overlap portion 766 may be located and configured to provide comfortable support in the arch area of the foot and the shoe. FIGS. 7A and 7B illustrate a seam cover 770 that may be provided to cover the plate overlap area 760 of the first plate 720 and the second plate 740. The seam cover 770 may be located on the underside of the first plate 720 and the second plate 740. FIG. 7A illustrates the seam cover 770 located on a topside of the first plate 720 and the second plate 740. FIG. 7B illustrates the seam cover 770 located on a bottom side of the first plate 720 and the second plate 740. A seam cover 770 may be located on the topside or the underside or both the topside and the underside of the first plate 720 and the second plate 740. The seam cover 770 may cover one or more of the overlap portions 762 764 766 in accordance with example embodiments.

Figure 8A:
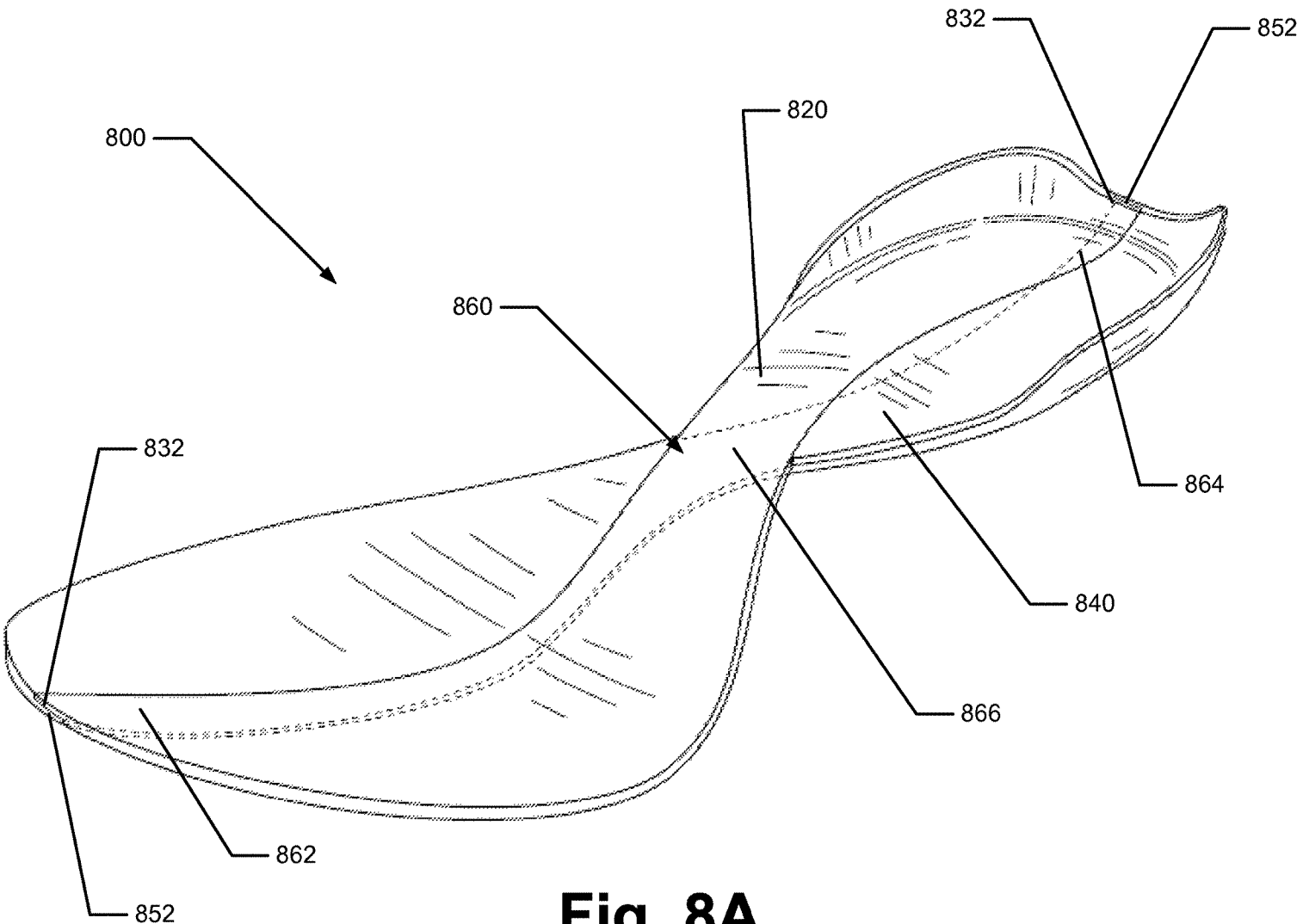
FIG. 8A illustrates a front-lateral perspective view of another example support element according to at least some embodiments.
Figure 8B:
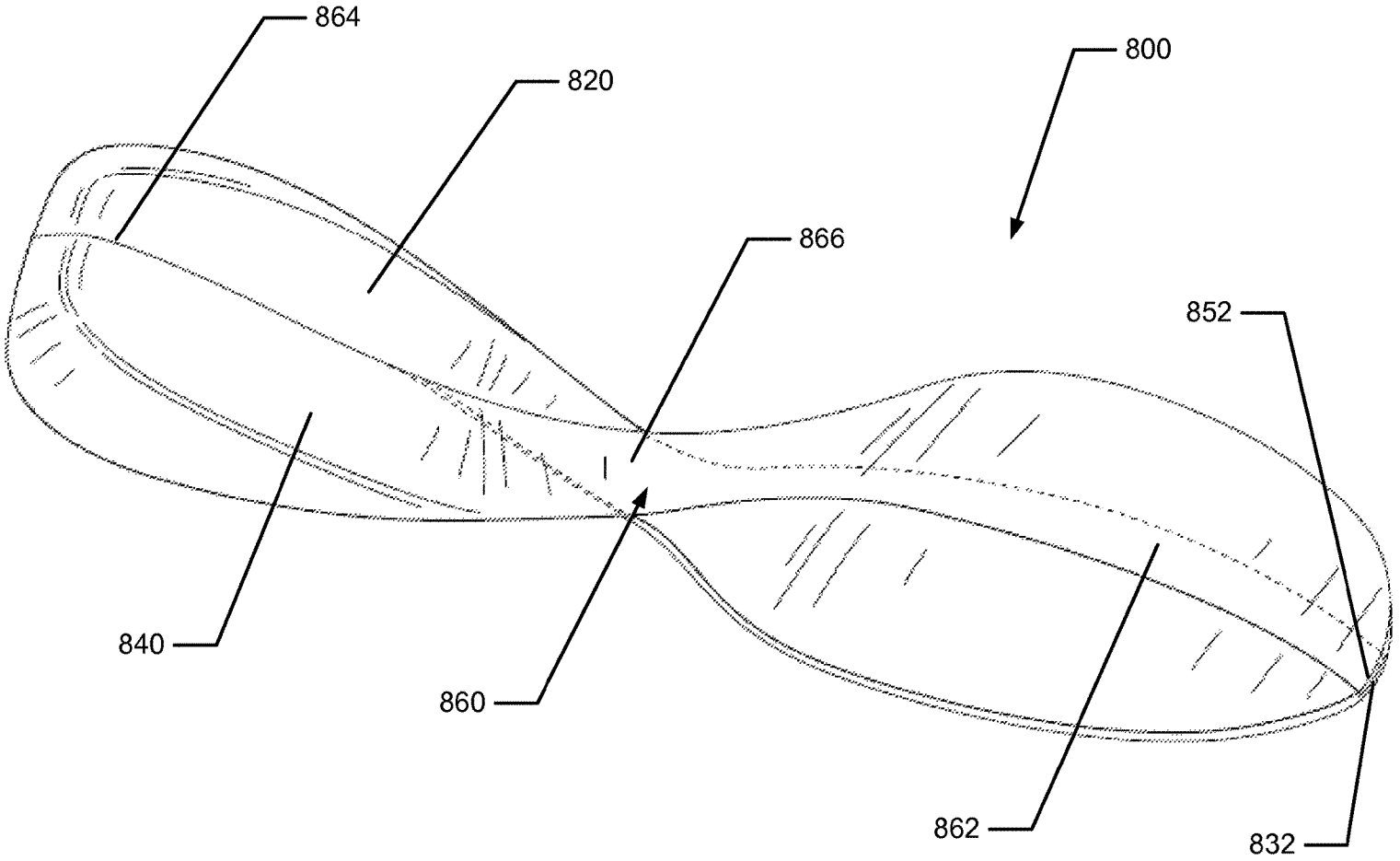
FIG. 8B illustrates a bottom-lateral perspective view of the support element of FIG. 8A.
Figure 8C:
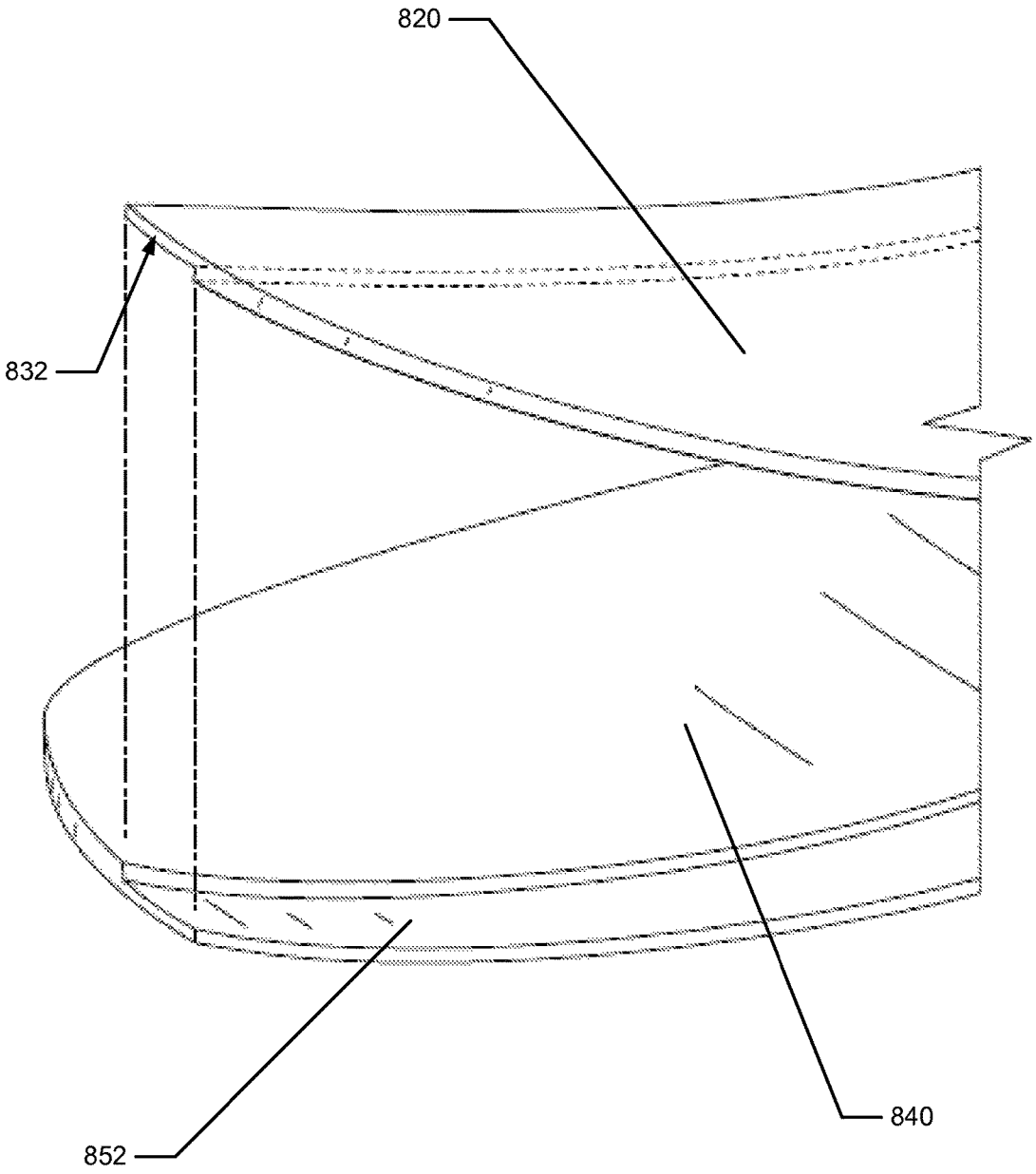
FIG. 8C illustrates an enlarged view of a forefoot portion of the support element of FIG. 8A.
Figure 8D:
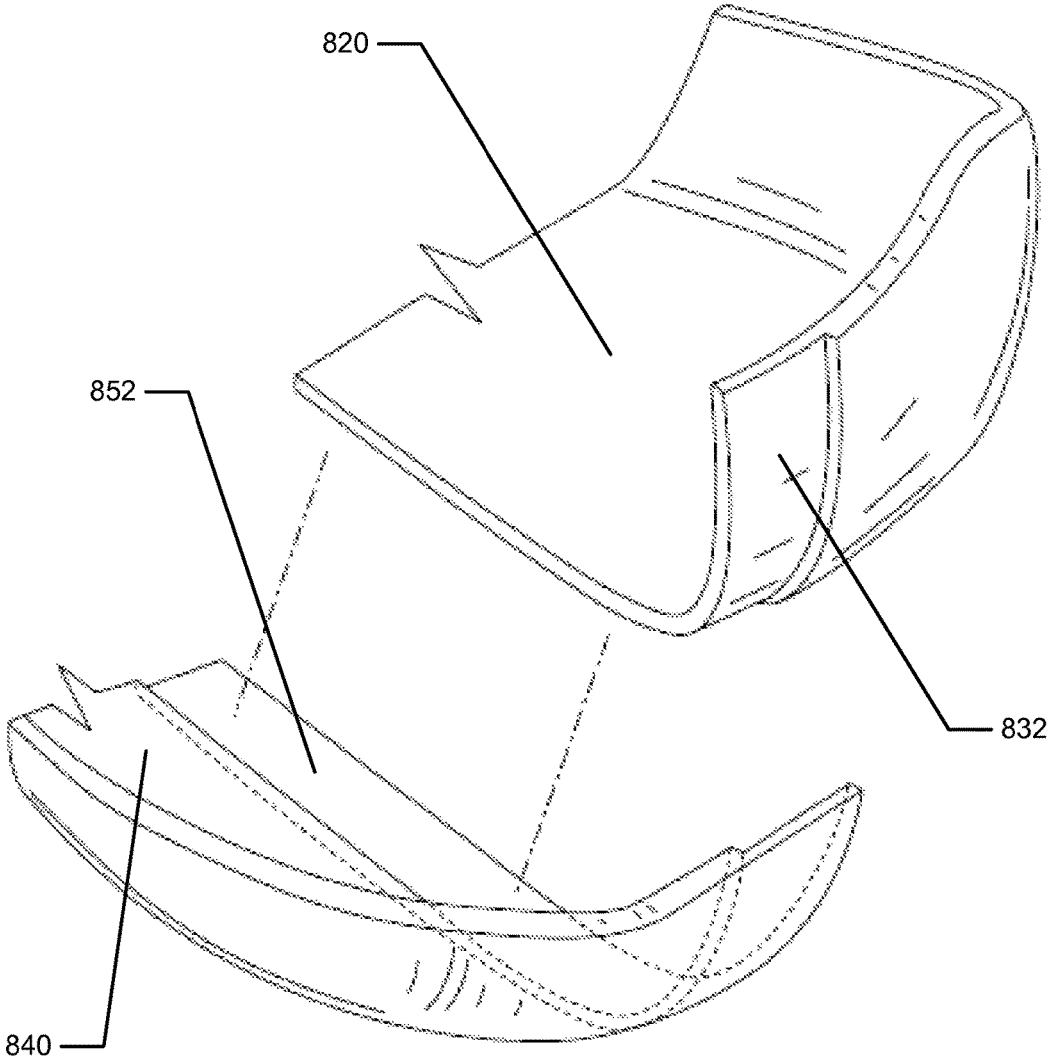
FIG. 8D illustrates an enlarged view of a heel portion of the support element of FIG. 8A.

FIGS. 8A through 8D illustrate a support element 800 in accordance with various further embodiments. FIG. 8A illustrates a front-lateral perspective view of the support element 800. FIG. 8B illustrates a bottom-lateral perspective view of the support element 800. FIG. 8C illustrates an enlarged view of a forefoot portion of the support element from FIG. 8A. FIG. 8D illustrates an enlarged view of a heel portion of the support element from FIG. 8A. The example support element 800 may include a first plate 820 and a second plate 840. The first plate 820 and the second plate 840 may extend longitudinally from a heel portion to a forefoot portion of a shoe. Generally, the first plate 820 may be oriented diagonally and extend diagonally from a lateral heel location in the shoe to a medial forefoot location in the shoe. The second plate 840 may be oriented diagonally and extend diagonally from a medial heel location of the shoe to a lateral forefoot location of the shoe.

The first plate 820 and the second plate 840 may include an overlap region 860. The overlap region 860 may include one or more overlap portions, such as forefoot overlap portion 862, a heel overlap portion 864, and an arch overlap portion 866. The overlap region may include one or more recesses provided for receiving one or more of the overlapping portions of the first plate 820 and the second plate 840. FIGS. 8A through 8D illustrate an example embodiment that includes recesses providing for receiving the overlapping portions. For example, the first plate 820 may include a first recess 832 located on a bottom surface of the first plate 820. The first recess 832 may be provided for receiving the overlapping portion of a top surface of the second plate 840. Optionally, if desired, the first recess 832 may be made somewhat thinner at the very end (e.g., at least at the overlapping portion). In this manner, when the user stands on the shoe in an upright manner, the bottom of the overall support element 800 is flush or substantially flush (e.g., smoothly contoured) at the overlapping portion. As alternatives, if desired, a second recess 852 or thinned area may be provided on a top surface of the second plate 840 for receiving the overlapping portion of a bottom surface of the first plate 820. As yet another alternative, if desired, no recessed portion need be provided. The recessed portion(s), when present, may be closely dimensioned to substantially match the shape of the overlapping area(s), or the recessed portion(s) may be somewhat or even substantially larger than the overlapping area(s). Additionally, the recessed portion(s), when present, may be located along any portion of or along the entire overlapping portion, which may include one or more of the following areas, such as the heel area, forefoot area, and the arch area.

The thickness of the support element and the plate members are exaggerated for purposes of explanation and illustration. The actual thickness of the first plate and the second plate may be between 5 mm and 35 mm in accordance with example embodiments.

D. Conclusion

In addition to shoes or articles of footwear, aspects of these embodiments can be practiced with other types of foot-receiving devices, i.e., any device into which a user places at least some portion of his or her foot. In addition to all types of footwear or shoes (e.g., as described above), foot-receiving devices include, but are not limited to: boots, bindings and other devices for securing feet in snow skis, cross country skis, water skis, snowboards, and the like; boots, bindings, clips, or other devices for securing feet in pedals for use with bicycles, exercise equipment, and the like; boots, bindings, clips, or other devices for receiving feet during play of video games or other games; and the like. Such foot-receiving devices may include: (a) a foot-covering component (akin to a footwear upper) that at least in part defines an interior chamber for receiving a foot; and (b) a foot-supporting component (akin to the footwear sole structure) engaged with the foot-covering component.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from above-described embodiments are the within the scope of the invention. With regard to claims directed to an apparatus, an article of manufacture or some other physical component or combination of components, a reference in the claim to a potential or intended wearer or a user of a component does not require actual wearing or using of the component or the presence of the wearer or user as part of the claimed component or component combination.

We claim:

1. A foot-supporting element for an article of footwear having a longitudinal axis extending from a heel region to a toe region of the article of footwear, comprising:

a first plate having a lateral edge, a medial edge, and a first heel support flange extending upwardly from an edge of the first plate in a heel end of the first plate, the lateral edge and the medial edge each extending diagonally with respect to the longitudinal axis such that the first plate extends from a lateral heel location of the article of footwear to a medial forefoot location of the article of footwear; and a second plate having a lateral edge, a medial edge, and a second heel support flange extending upwardly from an edge of the second plate in a heel end of the second plate, the lateral edge and the medial edge each extending diagonally with respect to the longitudinal axis such that the second plate extends from a medial heel location of the article of footwear to a lateral forefoot location of the article of footwear;

wherein the first plate is positioned entirely above the second plate, and the first plate and the second plate cross diagonally only in an overlap area located forward of the heel end and rearward of a toe end of each of the first and second plates.

2. A foot-supporting element according to claim 1, wherein the overlap area is defined where the first plate and the second plate cross at an arch area.

3. A foot-supporting element according to claim 1, wherein the first plate is crossed over a top side of the second plate.

4. A foot-supporting element according to claim 1, further comprising:

a seam cover located over the overlap area of the first plate and the second plate.

5. A foot-supporting element according to claim 1, wherein the first plate and the second plate are made from one or more of the following: one or more metals, one or more thermoset plastics, or one or more thermopolymers.

6. A foot-supporting element according to claim 1, wherein the toe end of the first plate is approximately half the width of a forefoot region of the foot-supporting element.

7. A foot-supporting element according to claim 1, wherein the heel end of the first plate is approximately half the width of a heel region of the foot-supporting element.

8. A foot-supporting element according to claim 1, wherein the toe end of the second plate is approximately half the width of a forefoot region of the foot-supporting element.

9. A foot-supporting element according to claim 1, wherein the heel end of the second plate is approximately half the width of a heel region of the foot-supporting element.

10. A foot-supporting element according to claim 1, wherein the first plate includes a first recess that receives an overlapping portion of a top surface of the second plate.

11. A foot-supporting element according to claim 10, wherein the first recess is located on a bottom surface of the first plate.

12. A foot-supporting element according to claim 10, wherein the second plate includes a second recess that receives an overlapping portion of a bottom surface of the first plate.

13. A foot-supporting element according to claim 12, wherein the second recess is located on a top surface of the second plate.

14. A foot-supporting element according to claim 12, wherein the first recess and the second recess are engaged such that a bottom surface of the foot-supporting element is flush at the overlapping portion.

15. An article of footwear, comprising:

an upper; and a sole structure engaged with the upper, wherein the sole structure includes a foot-supporting element according to claim 1.

16. An article of footwear according to claim 15, wherein the foot-supporting element is included in a midsole element of the sole structure.

17. A foot-receiving device having a longitudinal axis extending from a heel region to a toe region of the foot-receiving device, comprising:

a foot-covering member; and a support element engaged with the foot-covering member, the support element comprising:

a first plate having a lateral edge and a medial edge, the lateral edge and the medial edge each extending diagonally with respect to the longitudinal axis such that the first plate extends from a lateral heel location of the foot-receiving device to a medial forefoot location of the foot-receiving device;

a second plate having a lateral edge and a medial edge, the lateral edge and the medial edge each extending diagonally with respect to the longitudinal axis such that the second plate extends from a medial heel location of the foot-receiving device to a lateral forefoot location of the foot-receiving device; and a first heel support flange that extends upwardly from an edge of the first plate in a heel end of the first plate and a second heel support flange that extends upwardly from an edge of the second plate in a heel end of the second plate, wherein the first plate is positioned entirely above the second plate, and the first plate and the second plate cross diagonally only in an overlap area located forward of the heel end and rearward of a toe end of each of the first and second plates.

18. A foot-receiving device according to claim 17, further comprising:

a ground-contacting member engaged with the support element.

19. A foot-receiving device according to claim 18, wherein the foot-covering member forms at least a portion of an upper for the foot-receiving device, the support element forms at least a portion of a midsole for the foot-receiving device, and the ground-contacting member forms at least a portion of an outsole for the foot-receiving device.

20. A foot-receiving device according to claim 17, wherein the foot-covering member forms at least a portion of an upper for the foot-receiving device and the support element forms at least a portion of a sole structure for the foot-receiving device.

21. A foot-receiving device according to claim 20, wherein the first plate and the second plate are at least partially located between the upper and the ground-contacting member.

22. A foot-receiving device according to claim 17, wherein the overlap area is covered by a seam cover.

23. A foot-receiving device according to claim 17, wherein the first plate crosses over a top side of the second plate.

* * * * *